United States Patent [19]

Gnyp et al.

[11] 4,078,694

[45] Mar. 14, 1978

[54] OPENING MEANS FOR A CONTAINER

[75] Inventors: Andrew Gnyp; Karl Elert, both of Brookfield, Wis.

[73] Assignee: Jos. Schlitz Brewing Company, Milwaukee, Wis.

[21] Appl. No.: 757,844

[22] Filed: Jan. 10, 1977

[51] Int. Cl.[2] ..... B65D 41/32

[52] U.S. Cl. ..... 220/268; 220/269; 220/258

[58] Field of Search ..... 220/266–270, 220/258, 260, 359; 229/7 R; 222/541

[56] References Cited

U.S. PATENT DOCUMENTS

| | | | |
|---|---|---|---|
| 2,082,760 | 6/1937 | Berni | 220/268 |
| 3,843,011 | 10/1974 | Perry | 220/269 X |

*Primary Examiner*—George T. Hall

*Attorney, Agent, or Firm*—Andrus, Sceales, Starke & Sawall

[57] ABSTRACT

A lid construction for a pressurized beverage container. The lid has a pouring opening which is normally closed by a generally pointed tab that is integrally connected to the lid by a hinge section. The peripheral edge of the tab underlies the edge of the lid bordering the opening, and a strip of sealing material is applied to the underside of the lid and seals the joint between the tab and the lid. The sealing strip can be provided with a weakened zone or line located in spaced relation to the joint. To open the container, the consumer presses downwardly on the tab and the pointed tip of the tab will rupture the sealing strip and continued downward force will move the tab to the open position to expose the contents of the container.

8 Claims, 5 Drawing Figures

Fig. 1
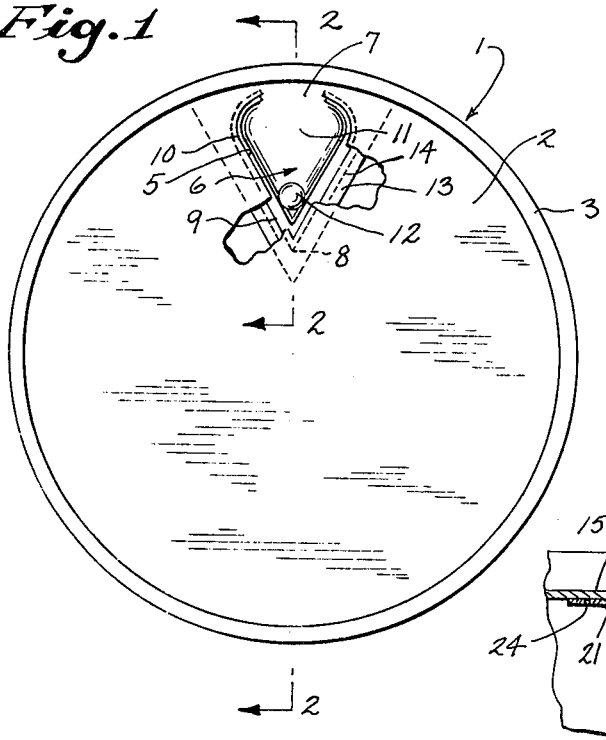
Fig. 4
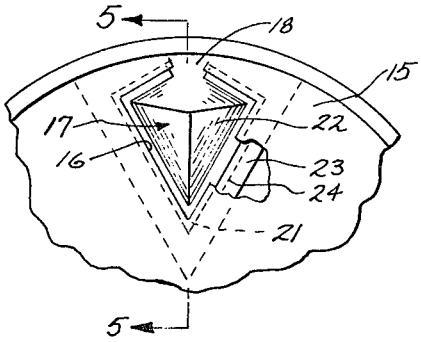
Fig. 5
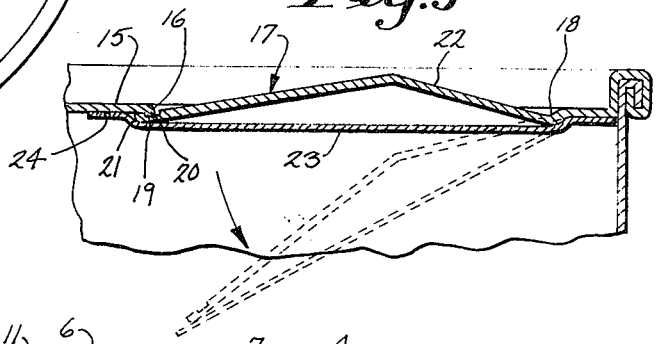
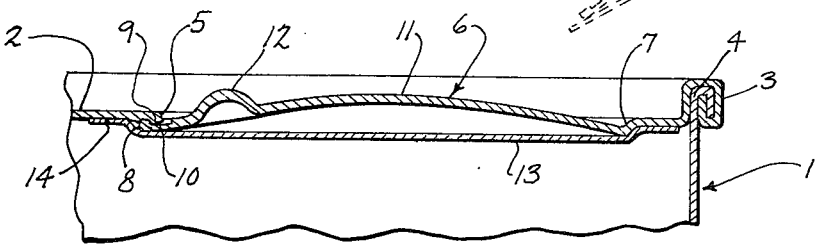
Fig. 2
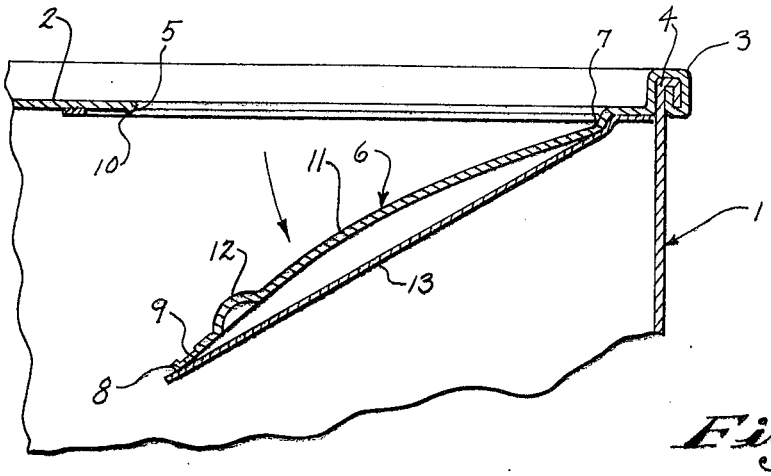
Fig. 3

OPENING MEANS FOR A CONTAINER

BACKGROUND OF THE INVENTION

Pull-type tabs have been commonly used to enclose pouring openings in the lids of carbonated beverage cans, such as soft drink or beer cars. The pull tab construction includes a ring that is secured to the tab, and by initially pivoting the ring from a horizontal position to a vertical position, the seal will be broken to vent the pressure from the can. Continued upward pulling on the ring will tear the tab from the opening. Discarding of the tab has not only resulted in an environmental problem, but the sharp edge of the tab provides a hazard which can cause lacerations to the feet or clothing.

To avoid the disadvantages associated with the pull-tab, there has been recent activity in the use of push tabs in which the tab is integrally connected to the lid and is pushed inwardly into the can in order to open the pouring opening. In one form of push tab construction, a single hole or opening is formed in the lid of the can which is enclosed by the tab. In certain instances, the tab is fully cut or scored through the lid with the scored joint being sealed on the inside by a sealant. Alternately, the tab can be partially scored in which case no internal sealant is required. As the cans usually contain a carbonated soft drink or beer, there is substantial internal pressure acting against the underside of the tab, and thus it is difficult to depress the tab against the internal pressure exerted by the beverage.

To facilitate opening, certain lid constructions have utilized a pair of openings, one being a larger pouring opening and the second being a small vent hole, each closed by a tab. With this type of construction, the vent tab is initially depressed to vent the internal pressure. With the internal pressure vented, the larger pouring tab can then be easily depressed to open the pouring hole. This type of construction, however, has certain disadvantages in that the consumer must be educated as to the manner of opening the can, meaning that special instructions must be imprinted or embossed on the can lid, indicating the manner in which the can is to be opened.

In another type of push tab arrangement, both the upper and lower surfaces of the lid are scored to define the tab and the scored lines are slightly off-set to provide a weakened joint. To open this type of push tab construction, the consumer must initially push downwardly along one side edge of the tab to rupture the weakened joint in that area and then push downwardly along the opposite side edge of the tab to rupture the weakened joint at that location. This construction has a disadvantage in that substantial pressure must be exerted to open the tab, and the consumer must be educated as to the proper manner of operation.

Non-pressurized containers have been formed in the past with push tabs having sharpened points, which when depressed, will rupture a lining material to expose the contents of the container. Container constructions of this type are illustrated in U.S. Pat. No. 2,082,760. In the construction of this patent the contents are contained within a sealed bag or envelope located within an outer metal container. The lid is provided with a pointed tab and when the tab is depressed, the pointed tip will rupture the envelope to expose the contents.

SUMMARY OF THE INVENTION

The invention is directed to an improved lid construction for a beverage can or container adapted to contain a carbonated beverage, such as beer or soft drinks. The lid is provided with a pouring opening which is normally closed by a generally pointed tab which is integrally connected to the lid by a hinge section.

The peripheral edge of the tab is located beneath the edge of the lid bordering the opening, and a strip of sealing material is applied to the underside of the lid and seals the joint between the tab and the lid. The sealing strip is preferably formed with a weakened zone, such as a line of perforations, which is spaced or offset from the joint to be sealed.

The central portion of the tab has a generally convex contour and an upwardly extending hump or dimple is provided on the tab adjacent the sharpened tip.

By pushing inwardly on the hump, the sharpened tip will be depressed and will rupture the sealing strip, and continued downward pressure on the tab will pivot the tab inwardly to expose the contents of the can.

The lid construction of the invention incorporates a single tab-enclosed opening which can be opened with minimum pressure. The incorporation of the hump or dimple adjacent the pointed tip of the tab acts to concentrate the force adjacent the pointed tip to facilitate rupturing of the sealing strip.

The sealing strip provides an effective seal for the joint between the tab and the lid, and the weakened zone formed in the strip enables the strip to be torn away with minimum force and yet the weakened zone will not adversely effect the sealing characteristic of the strip.

As the tab is integrally connected to the lid, it cannot be detached and this eliminates the problem of disposal of the tabs.

The location and configuration of the tab is such that no special instructions are required in order to educate the consumer as to the manner of opening the tab.

Other objects and advantages will appear in the course of the following description.

DESCRIPTION OF THE DRAWINGS

The drawings illustrate the best mode presently contemplated of carrying out the invention.

In the drawings:

FIG. 1 is a top plan view of the lid construction of the invention;

FIG. 2 is a section taken along line 2—2 of FIG. 1 and showing the tab in the closed position;

FIG. 3 is a view similar to FIG. 2 showing the tab in the open position;

FIG. 4 is a top plan view of a modified form of the lid construction of the invention; and FIG. 5 is a section taken along line 5—5 of FIG. 4 and showing the tab in the closed position with the phantom lines indicating the position of the tab in the open position.

DESCRIPTION OF THE PREFERRED EMBODIMENT

FIGS. 1–3 illustrate a conventional metal can body or container 1 having an open end which is enclosed by a lid 2. The peripheral edge of the lid 2 is provided with a rolled chime 3 which is clamped to the upper edge 4 of the can body 1. The can is adapted to contain a liquid, such as a carbonated soft drink, beer, malt liquor, or the like, which is normally packaged under an internal pressure greater than atmospheric.

The lid 2 is provided with a pouring opening 5 which is located adjacent the periphery of the lid and a tab 6 encloses the opening and is integrally connected or hinged to the lid 2 by a hinge section 7. As best illustrated in FIG. 1, the side edges of the tab converge to a pointed tip 8.

The peripheral edge 9 of the tab 6 is coined and is located beneath the downwardly rolled edge 10 of lid 2 which borders the opening 5. As the peripheral edge 9 underlies the edge 10 of the lid, the internal pressure within the can body will act to maintain the edge 9 in engagement with the edge 10.

The central portion 11 of tab 6 is generally convex or domed, and the portion of the tab located adjacent the pointed tip 8 is provided with an upwardly extending hump or dimple 12 which projects upwardly beyond the upper surface of the lid 2.

To seal the joint between the edges 9 and 10, a strip of sealing material 13 is applied to the undersurface of the lid and covers the joint between the edges 9 and 10. The sealing strip 13 is a conventional material formed of metal foil or plastic film with an adhesive backing which secures the strip to the underside of the lid to provide a hermetic seal. The strip 13 is preferably formed with a generally triangular shape to complement the shape of the tab 6, and the triangular configuration enables the strips 13 to be cut from a coil without scrap.

The sealing strip 13 can be formed with a line 14 of perforations or slits which is spaced outwardly of the joint between the edges 9 and 10 and serves as a weakened zone to facilitate rupturing of the sealing strip. The line 14 can extend completely around the tab 6, or can extend around only a portion of the tab, preferably around the pointed tip 8. As the perforated line 14 is spaced from the joint between the edges 9 and 10, the perforations will not effect the seal, but will enable the strip to be more readily torn away when downward pressure is applied to the tab.

As previously noted, the container or can body 1 is adapted to contain a pressurized carbonated beverage which is under an internal pressure greater than atmospheric. To open the container, the consumer presses downwardly on the hump 12 and the downward force will be concentrated adjacent the pointed tip 8, causing the tip to move downwardly and rupture the sealing strip 13, to vent the pressure within the can.

Continued downward pressure on the tab will sever the weakened zone or perforations 14 and the tab will pivot downwardly into the interior of the can to expose the contents.

As the tab is integrally connected to the lid, it will at all times remain attached to the lid, thereby eliminating the problem of discarding the tabs which is an environmental problem associated with pull tabs.

As the lid has a single opening, the construction is simplified. The combination of the pointed tip 8 on the tab 6, along with the force-concentrating hump 12 enables the consumer to readily rupture the sealing strip 13 to vent the pressure so that the tab 6 can be readily depressed into the can to expose the contents.

FIGS. 4 and 5 show a modified form of the invention in which the lid 15 of the can body is provided with an opening 16, and a tab 17 closes the opening and is integrally connected to the lid by hinge section 18. As in the case of the first embodiment, the peripheral edge 19 of the tab is coined and is located beneath the downwardly rolled edge 20 of the lid 15 which borders the opening 16.

As shown in FIG. 4, the side edges of the tab 17 are generally straight and terminate in a sharpened point or tip 21, while the central portion 22 of the tab has a convex, pyramidal shape.

A sealing strip 23, similar to strip 13 of the first embodiment, is applied to the undersurface of the lid and covers the joint between the edges 19 and 20. As described with respect to the first embodiment, a line 24 of perforations or slits, which constitutes a weakened zone, can be formed in the strip and is located in offset relation to the joint between the edges 19 and 20.

To open the container, the consumer presses downwardly on the central portion 22 of the tab 17, and the downward force will cause the tip 21 to rupture the sealing strip 23 to vent the pressure within the can. Continued downward pressure on the tab 17 will sever the line of perforations 24 and pivot the tab downwardly into the interior of the can to expose the contents.

Various modes of carrying out the invention are contemplated as being within the scope of the following claims particularly pointing out and distinctly claiming the subject matter which is regarded as the invention.

We claim:

1. A lid construction for a container, comprising a lid having an opening therein, a tab to close the opening, said tab being integrally connected to the lid by a hinge section and having its peripheral edge remote from said hinge section underlying the edge of the lid bordering the opening, sealing material disposed on the underside of the lid and covering at least the joint between the tab and the edge of the lid bordering said opening to provide a seal, and a weakened zone in said sealing material along the peripheral edge of said tab but spaced from said peripheral edge, initial downward pressure applied to said tab causing said sealing material to rupture along said weakened zone and continued downward pressure causing said tab to pivot inwardly about said hinge section to open said opening and expose the contents of the container.

2. The lid construction of claim 1, wherein said weakened zone is located along a line which extends along the major portion of the peripheral edge of said tab, and is spaced outwardly thereof.

3. The lid construction of claim 2, wherein said weakened zone comprises a line of perforations which extends around substantially the entire peripheral edge of said tab except for said hinged section.

4. The lid construction of claim 1, wherein said sealing material comprises a backing layer of a liquid impervious material and an adhesive coating bonding said material to the undersurface of the lid.

5. A lid construction for a container, comprising a lid having an opening therein to serve as a pouring spout, a tab to close the opening and integrally connected to the lid by a hinge section, and a sealing material disposed on the underside of the lid and covering at least the joint between the tab and the edge of the lid bordering said opening to provide a seal, said material having a weakened zone along a line which extends along said joint but is spaced outwardly from said joint, initial downward pressure applied to said tab causing its periphery remote from said hinged section to rupture said sealing material along said weakened zone and continued downward pressure causing said tab to pivot inwardly about said hinge section to open said opening and expose the contents of the container.

6. The lid construction of claim 4, wherein the lateral area of the tab is greater than that of the opening in the lid, the edge of the lid bordering the opening overlies the peripheral edge of the tab, and the edge of the lid bordering the opening has a downward extension which extends to the underlying tab.

7. The lid construction of claim 6, wherein the tab includes a recess extending along its periphery, and the downward extension of the lid mates with such recess.

8. The lid construction of claim 5, wherein the tab includes a pair of side edges extending from said hinge section, said side edges converge to a pointed tip.

* * * * *